US006571695B1

(12) United States Patent
Holmen et al.

(10) Patent No.: US 6,571,695 B1
(45) Date of Patent: Jun. 3, 2003

(54) ARTICLE COMPACTING DEVICE

(75) Inventors: Kristian Holmen, Asker (NO); Kaj Johnsen, Bødalen (NO)

(73) Assignee: Tomra Systems ASA, Asker (NO)

( * ) Notice: Subject to any disclaimer, the term of this patent is extended or adjusted under 35 U.S.C. 154(b) by 0 days.

(21) Appl. No.: 09/674,884

(22) PCT Filed: May 20, 1999

(86) PCT No.: PCT/NO99/00159

§ 371 (c)(1),
(2), (4) Date: Nov. 7, 2000

(87) PCT Pub. No.: WO99/61231

PCT Pub. Date: Dec. 2, 1999

(30) Foreign Application Priority Data

May 22, 1998 (NO) ..... 982341

(51) Int. Cl.[7] ..... B30B 5/04

(52) U.S. Cl. ..... 100/155 R; 100/151; 100/902; 100/163 R; 100/169; 100/171

(58) Field of Search ..... 100/902, 158 R, 100/157, 156, 155 R, 151, 153, 161, 163 R, 163 A, 171, 169

(56) References Cited

U.S. PATENT DOCUMENTS 657,761 A * 9/1900 Davison ..... 100/162 R
1,140,676 A * 5/1915 Gray ..... 100/151
3,996,848 A * 12/1976 Molitorisz ..... 100/73
4,018,394 A * 4/1977 Sorbier ..... 144/2.1
4,221,040 A * 9/1980 Good ..... 29/403.2
4,501,198 A * 2/1985 Johansson et al. ..... 100/151
4,599,131 A * 7/1986 Matuszak ..... 15/60
4,987,829 A * 1/1991 Hudson et al. ..... 100/137
5,211,109 A * 5/1993 Determan ..... 100/172

FOREIGN PATENT DOCUMENTS

DE 3907791 A * 10/1989 ..... B02C/19/12

* cited by examiner

*Primary Examiner*—Allen Ostrager
*Assistant Examiner*—Shelley Self
(74) *Attorney, Agent, or Firm*—Rodman & Rodman

(57) ABSTRACT

An apparatus for the compaction of articles, e.g., disposable metal cans or disposable plastic bottles, includes a pair of mutually counter-rotatable, interacting squeeze rollers, wherein the first roller has a fixed support and wherein the second roller is supported in an arm-spring assembly, thereby enabling the space between the rollers to be varied according to the size and compactability of the article. In addition, the apparatus has a precompactor that includes a conveyor, e.g., a belt or chain conveyor, and an elongate press plate inclined relative to the conveyor and preferably spring-loaded, to ensure that the article is gradually flattened upstream of the squeeze rollers. The squeeze roller may be provided with an incurvate middle portion and, optionally with openings having an L, U or V-shaped cross section with gripping edges in order to facilitate the feeding of the articles, such as bottles having a mouth and bottom nipple, through the compactor.

8 Claims, 8 Drawing Sheets

FIG. 2
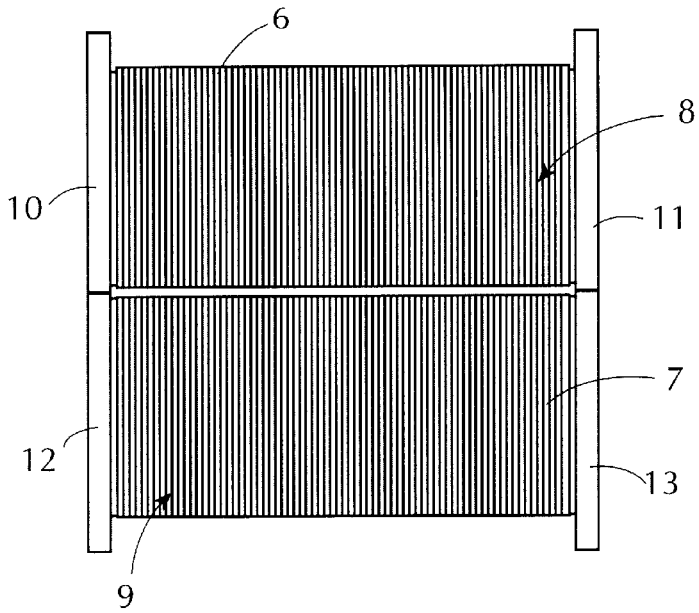
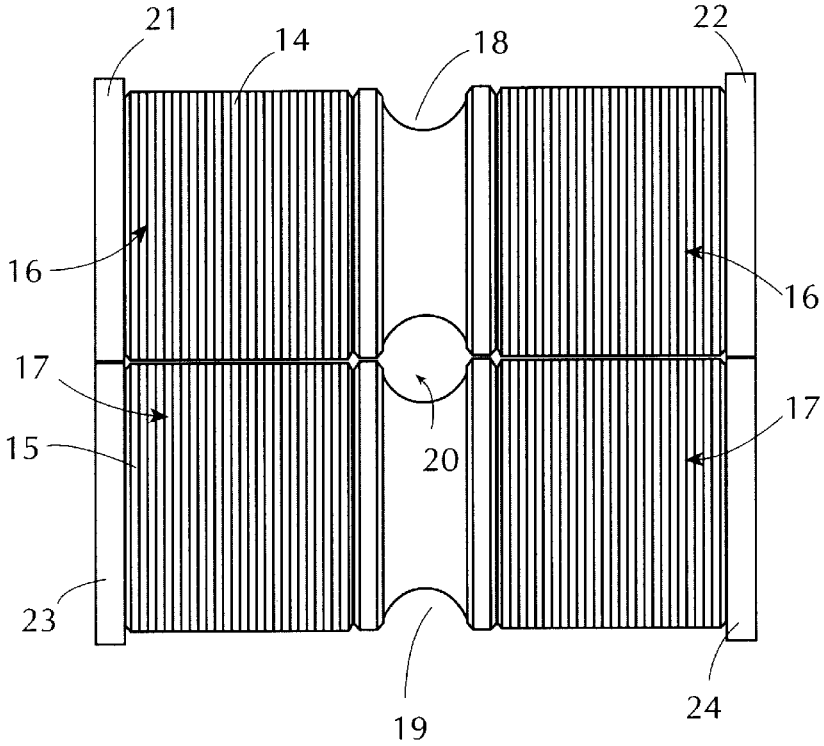
FIG. 3

FIG. 9
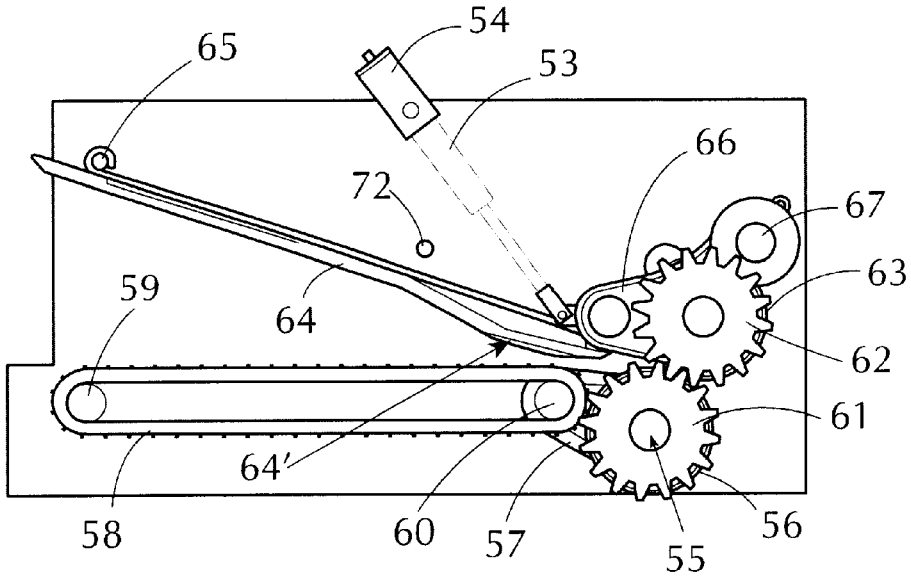
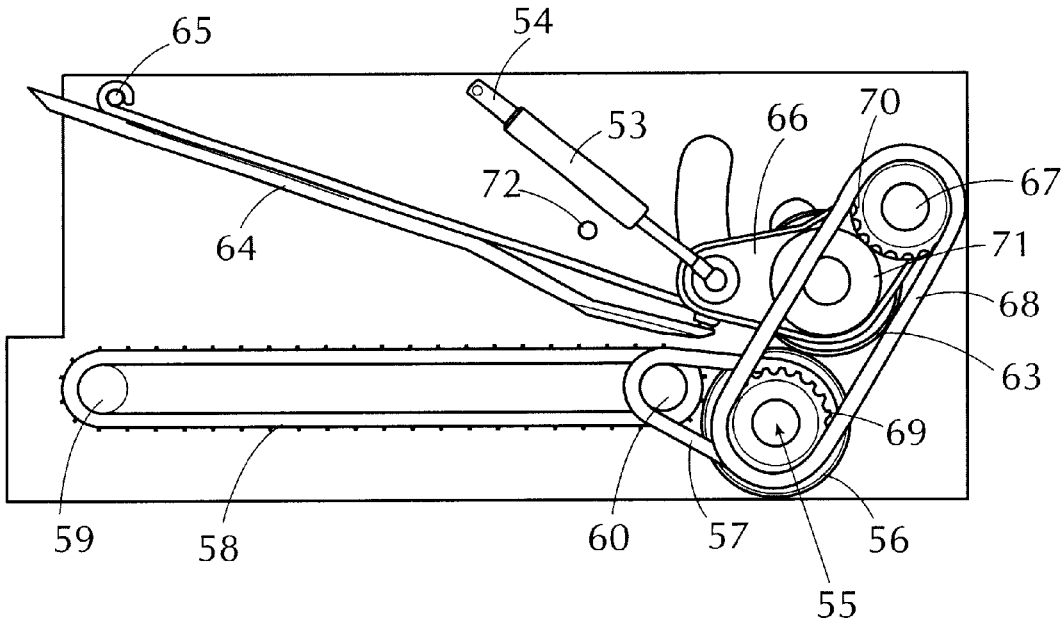
FIG. 10

ARTICLE COMPACTING DEVICE

BACKGROUND OF THE INVENTION

The present invention relates to an apparatus for the compacting of articles e.g., disposable plastic bottles, consisting of a pair of mutually counter-rotatable interacting squeeze rollers, wherein the first roller has a fixed support and wherein the second roller is supported in an arm-spring assembly, thereby enabling the space between the rollers to be varied according to the size and compactability of the article, and wherein the apparatus in addition is provided with a precompactor consisting of a conveyor, e.g., a belt or chain conveyor, and an elongate squeeze device inclined relative to the conveyor and preferably spring-loaded, to ensure that the article is gradually flattened upstream of the squeeze rollers.

An apparatus of this kind is known, for example, from Finnish Patent 93175.

However, a compactor of the said type has the drawback that the compaction becomes sufficient. When using a compactor apparatus of this kind in connection with a reverse vending machine for cans and/or bottles, it is essential that the articles are flattened and remain permanently flat, as this is necessary in order to be able to transport a large number of returned goods of this kind in an inexpensive manner. When compacting, e.g., plastic bottles, the bottle neck and any screw cap attached thereto, and the concave bottom nipple of the bottle will, often cause compaction problems.

OBJECTS AND SUMMARY OF THE INVENTION

The object of the invention is therefore to provide a special squeeze roller device, and a precompactor for articles, e.g., disposable metal cans or disposable plastic bottles which are to be compacted, and wherein the precompactor feeds the articles to a subsequent final compactor.

The object of the present invention is therefore to overcome the drawbacks associated with the prior art and to provide a solution which provides a best possible compaction.

According to the invention, the aforementioned apparatus is characterised in that the rollers have an incurvate middle portion so as to provide a virtually clear passageway for the mouth and bottom nipple of the article. This allows a best possible total compaction of the article to be obtained.

In an alternative embodiment, the apparatus is characterised in that there is cut out in the surface of the rollers at least one opening or recess having an L, U or V-shaped cross-section and having a gripping edge, so that the gripping edges on opposing rollers directly interact, and upon their rotation as a pair will abut, the interacting gripping edges having the same radial distance from the rotation axis of the respective roller, and in that on such interaction the depressions in the rollers form a space therebetween. This is of importance if the article, e.g., enters askew as it moves towards the squeeze rollers or has elements which otherwise will not easily pass the rollers.

Additional embodiments of the apparatus will be apparent from the following description with reference to the attached drawings, and from the attached patent claims.

DESCRIPTION OF THE DRAWINGS

The invention will now be described in more detail with reference to the attached drawings.

FIG. 2 is an elevational view of a first embodiment of the squeeze rollers of the compactor apparatus, preferably for the compression of disposable metal cans.

FIG. 3 shows a second embodiment of the squeeze rollers of the compactor apparatus, preferably for the compaction of disposable plastic bottles.

FIG. 9 shows a modification of the compactor apparatus.

FIG. 10 shows a further modification of the compactor apparatus.

DETAILED DESCRIPTION OF THE INVENTION

The compactor apparatus consists of a precompactor 1 and a final compactor 2. Under normal conditions the precompactor 1 will, whilst pre-compacting articles in the form of metal cans, e.g., of aluminum and/or steel, forcibly feed the articles into the final compactor 2, so that the articles can easily be gripped by the rollers 2', 2" of the final compactor. It is therefore a prerequisite that the precompactor 1 carries out an effective precompacting per se so that it is sufficiently feasible for the rollers 2', 2" to carry out a final compaction. This is particularly important in the event of substantially horizontal insertion into and passage through the precompactor. To accomplish the aforementioned compaction, it is essential that both the precompactor 1 and the rollers 2', 2" are able to adjust to and maintain a virtually constant force of compaction on articles of a normal compactable type. In the proposed embodiment, which does not define the limits of the invention, the precompactor 1 which functions simultaneously as a forward feeder, may consist of a belt or chain conveyor 1' and a squeeze device 1", e.g., a press plate or conveyor, e.g., of the belt or chain type, disposed at an angle $\alpha$ relative thereto.

The angle $\alpha$ between the two main parts 1', 1" of the precompactor is preferably in the range of 15° to 45°. An especially preferred angle may be about 20°. In the further discussion of the compactor apparatus, e.g., in connection also with FIGS. 6–10, part 1' of the precompactor 1 is in the form of an inclined press plate. However, this design should not be seen in any way as defining the limits of the invention. The lower roller 2" is fixedly supported and the upper roller 2' is supported in a highly schematically indicated arm-spring assembly 3 which will be described in more detail in connection with the embodiments that can be seen in FIGS. 4–10. The squeeze device 1" will turn about a centre of rotation 1" and preferably be spring-loaded by means of a spring mounting 4.

The squeeze device 1" may conceivably be mechanically connected to the arm-spring assembly 3 of the roller 2', so that the rotational motion of the squeeze device 1" will actuate the motion of the assembly 3, and thus also the rotation of the roller 2'. In a solution of this kind the spring mounting may be omitted.

Figure 1:
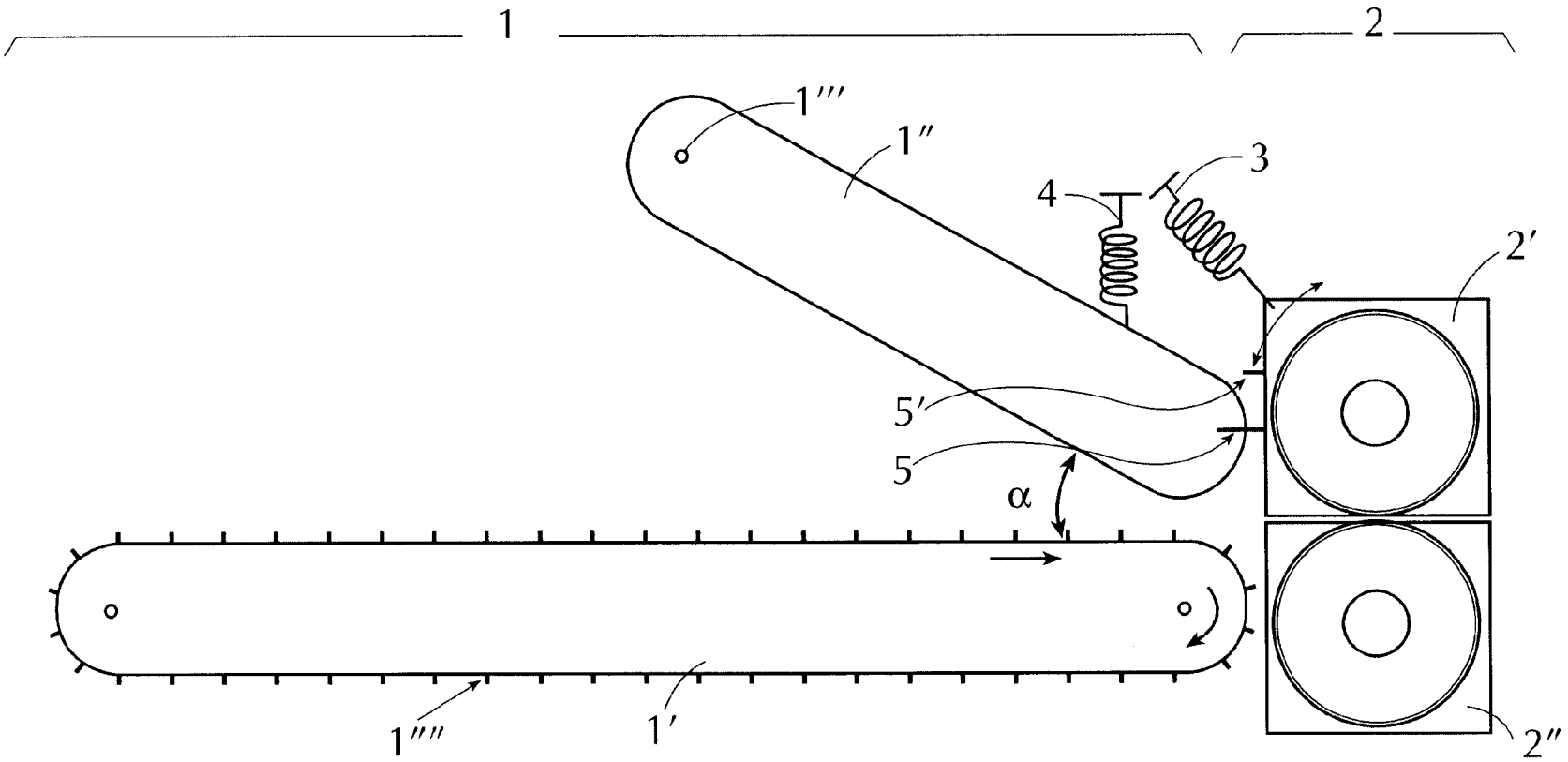
FIG. 1 is a schematic outline of the principle of the compactor apparatus according to the invention.

When there is a separate springing as indicated in FIG. 1, the arm-spring assembly 3 of the final compactor and thus the motion of the roller 2' relative to the roller 2" may be completely independent of one another.

Another solution is to use separate springing for the precompactor 1 and the final compactor 2, but to include a mechanical coupling 5, 5' as indicated schematically, so that the squeeze device 1" will only cause rotational motion of the arm-spring assembly 3 of the final compactor and thus a space between the rollers 2', 2" when the downstream end of the squeeze device moves upwards more than a predetermined distance. Normally the space between the rollers should be as small as possible so that best possible final compaction is obtained.

To ensure a good forcible forward feed of articles, the conveyor 1' is preferably provided with gripping means 1"", such as, e.g., spikes, barbs, friction facing or the like.

The squeeze rollers according to FIG. 2 consist of two counter-rotating rollers 6, 7. The rollers may optionally be provided with a friction-generating surface, e.g., in the form of serrations 8, 9, to improve the gripping power of the rollers. The rollers 6, 7 are especially designed for the compaction of articles such as disposable metal cans. Initially, the rollers 6, 7 are rotatably supported on respective mounts 10, 11 and 12, 13.

In the event that it is desirable to compress articles such as, e.g., disposable plastic bottles, it will be necessary to design the squeeze rollers somewhat differently. In this connection, reference will be made to FIG. 3 which shows two counter-rotating rollers 14, 15. The rollers may be provided with an optional friction-generating surface, e.g., formed by means of serrations 16, 17 in order to improve the gripping power of the rollers. The squeeze rollers 14, 15 have a respective recessed portion 18, 19 in the middle thereof in order to provide a virtually clear passageway 20 for the mouth and bottom nipples of the bottles, whilst the portions at the sides of the recessed portion 18, 19 have a very small clearance. Squeezing the lateral edges of the articles, in this case, e.g., bottles, completely flat, will result in a permanent deformation in the bend that occurs and thus the article will remain permanently flat, apart from the area around the mouth and the bottom nipple.

Ideally, the rollers 14, 15 are rotatably supported in respective mounts 21, 22 and 23, 24.

Just as the aim in the case of cans is to obtain a maximum axial motion towards the final compactor 2, so it will of course also be important to aim to guide the bottle mouth and bottom nipple towards the recessed portions 18, 19 of the rollers 14, 15 which together form the passageway 20, so as to allow the mouth and bottom nipple to pass through the final compactor without causing any particular problems. This can be effected by there being an appropriate distance between the side walls 25, 26 of the precompactor, see FIG. 8. It must also be noted that as soon as the gripping means 1"" on the conveyor 1' grip the bottle, the onward direction of the forcible feed and direction towards the ring-shaped passageway 20 formed between the rollers will be determined. A correct insertion at the upstream end of the precompactor 1 is thus essential. The mouth and bottom nipple of the bottle can thus easily be guided actively towards the recessed portions 18, 19 and the passageway 20.

If a can enters the precompactor askew or perhaps is not sufficiently precompacted, the rollers 6, 7 will not be able to grip the can properly and compress it further. To avoid precisely this problem, there is provided in each roller, indicated in FIG. 4 by the reference numerals 6', 7', at least one respective depression or opening 27 and 28 having is gripping edge 27' and 28' . As can be seen from FIG. 4, the gripping edges 27', 28'have same radial distance from rotation axis of the respective roller 6', 7'. Further, the innermost edges 27", 28" of the rollers 6', 7' have also a same radial distance from rotation axis of the rollers. The openings preferably have an L, U or V-shaped cross-section and extends across the entire width of the rollers 6', 7'. Since the rollers 6', 7'are made to turn synchronously via gearing 29, 30, the said gripping edges 27' and 28'will in a pincher movement grip a part of the can which is unable to enter the gap between the rollers. This may result in the can either being swept along through the space between the rollers in the final compactor or being gripped bit by bit and pulled through. The space formed between the openings 27, 28 will normally be large enough to take, e.g., non-precompacted parts of or on the can. Of course, it will be possible to arrange several openings of this kind across the rollers along the periphery thereof, but normally at least one opening of this kind per roller will be advantageous and sufficient.

Figure 4:
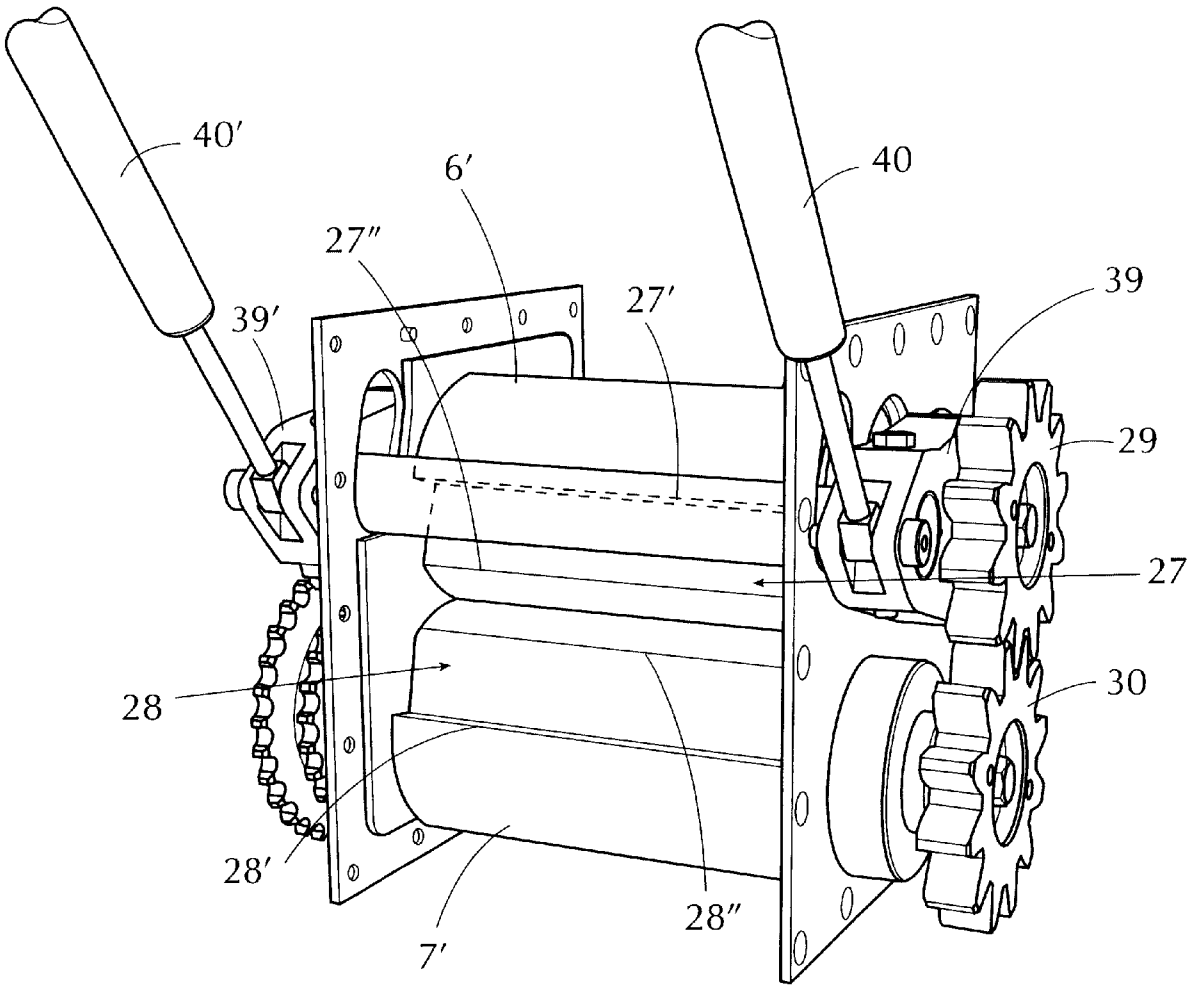
FIG. 4 shows as a modification of the first embodiment, and in a perspective view, a third embodiment of squeeze rollers mounted on an arm-spring assembly.
Figure 5:
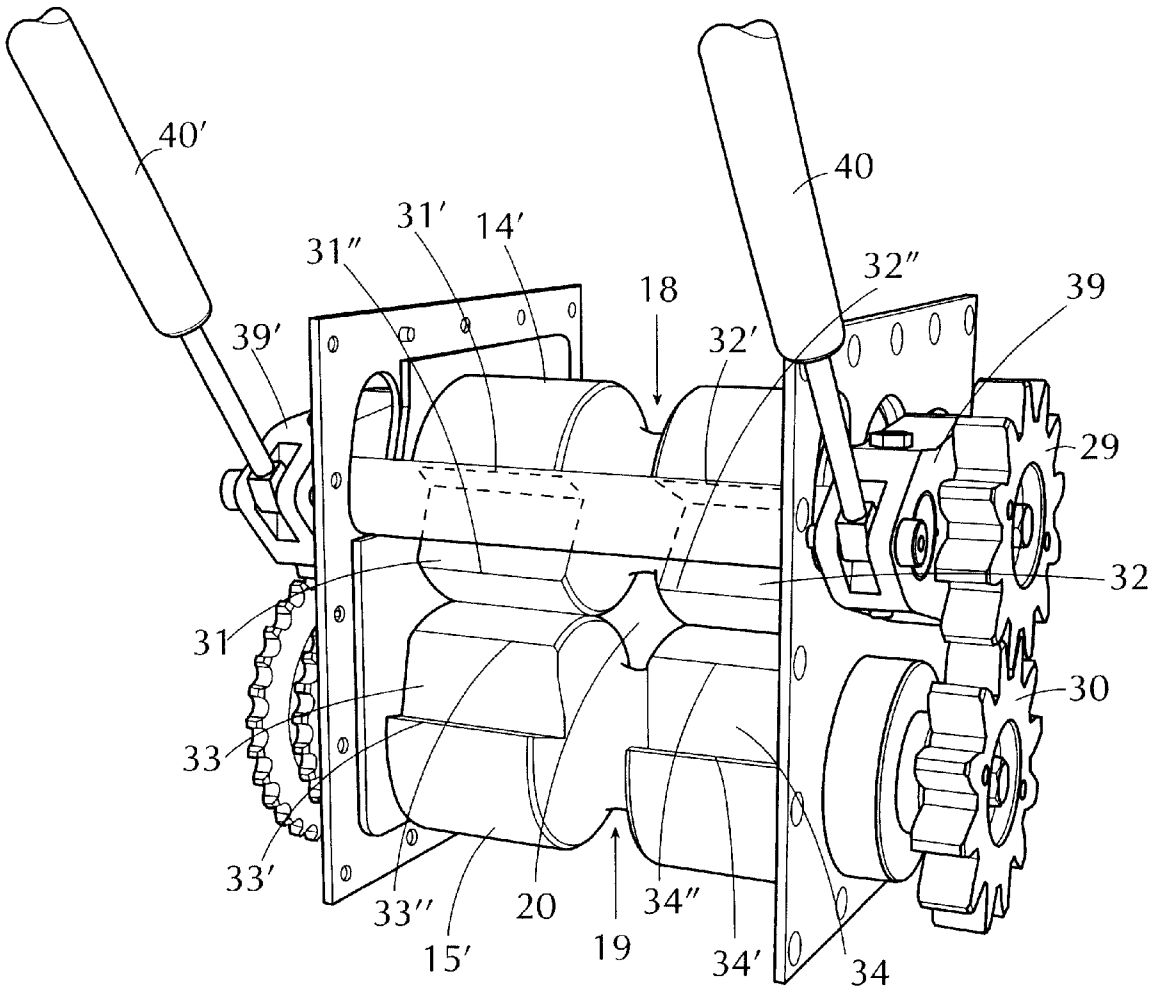
FIG. 5 shows as a modification of the second embodiment, and in a perspective view, a fourth embodiment of squeeze rollers mounted on an arm-spring assembly.

If a bottle enters the precompactor somewhat askew, so that the mouth and/or bottom nipple of the bottle does not encounter the passageway 20, there is for this purpose provided in the surface of each roller 14', 15', as indicated in FIG. 5, on each side of the respective recessed portion 18, 19 thereof, at least one opening 31, 32 and 33, 34 in the rollers 14,', 15' having gripping edges 31', 32' and 33', 34'. As can be seen from FIG. 5, the gripping edges 31', 33' and 32', 34' have same radial distance from rotation axis of respective roller 14', 15'. Further, the innermost edges 31 ", 33" and 32", 34" also have a same radial distance from the rotation axis of the rollers. The openings preferably have an L, U or V-shaped cross-section and extend across the entire width of the rollers 14', 15', i.e., on each side of the respective recessed part 18, 19. Since the rollers 14', 15' have synchronised rotation via the gearing 29, 30, the said gripping edges 31', 32', 33' and 34' will in a pincher movement grip a bottle part, e.g., the mouth or bottom nipple which has not come into the gap between the rollers or through the passageway 20 and will either carry the bottle through the final compactor or grip the bottle bit by bit and pull it through. The space formed between the depressions or openings 31, 32 and 33, 34 will normally be large enough to take a bottle mouth or bottom nipple. Of course, it will be possible to provide several transverse openings 31–34 along the periphery of the rollers, but normally at least one such opening on each roller will be regarded as advantageous and sufficient The invention will now be described with reference to FIGS. 6 and 7, but details already described in connection with FIGS. 4 and 5 will not be repeated.

The compactor apparatus has a precompactor consisting of a belt or chain conveyor 35 (denoted by reference number 1' in FIG. 1 and denoted by reference number 58 in FIGS. 9 and 10) and a squeeze device 36 (denoted by reference number 1" in FIG. 1 and denoted by reference number 64 in FIGS. 9 and 10) in the form of a press plate which acts almost as a slide plate, and which is inclined relative to the conveyor 35 at an angle $\alpha$, e.g., in the range of 15–45°, preferably 20°. As an alternative, as indicated in connection with FIG. 1, the squeeze device 36 may be in the form of a belt or chain conveyor.

Figure 6:
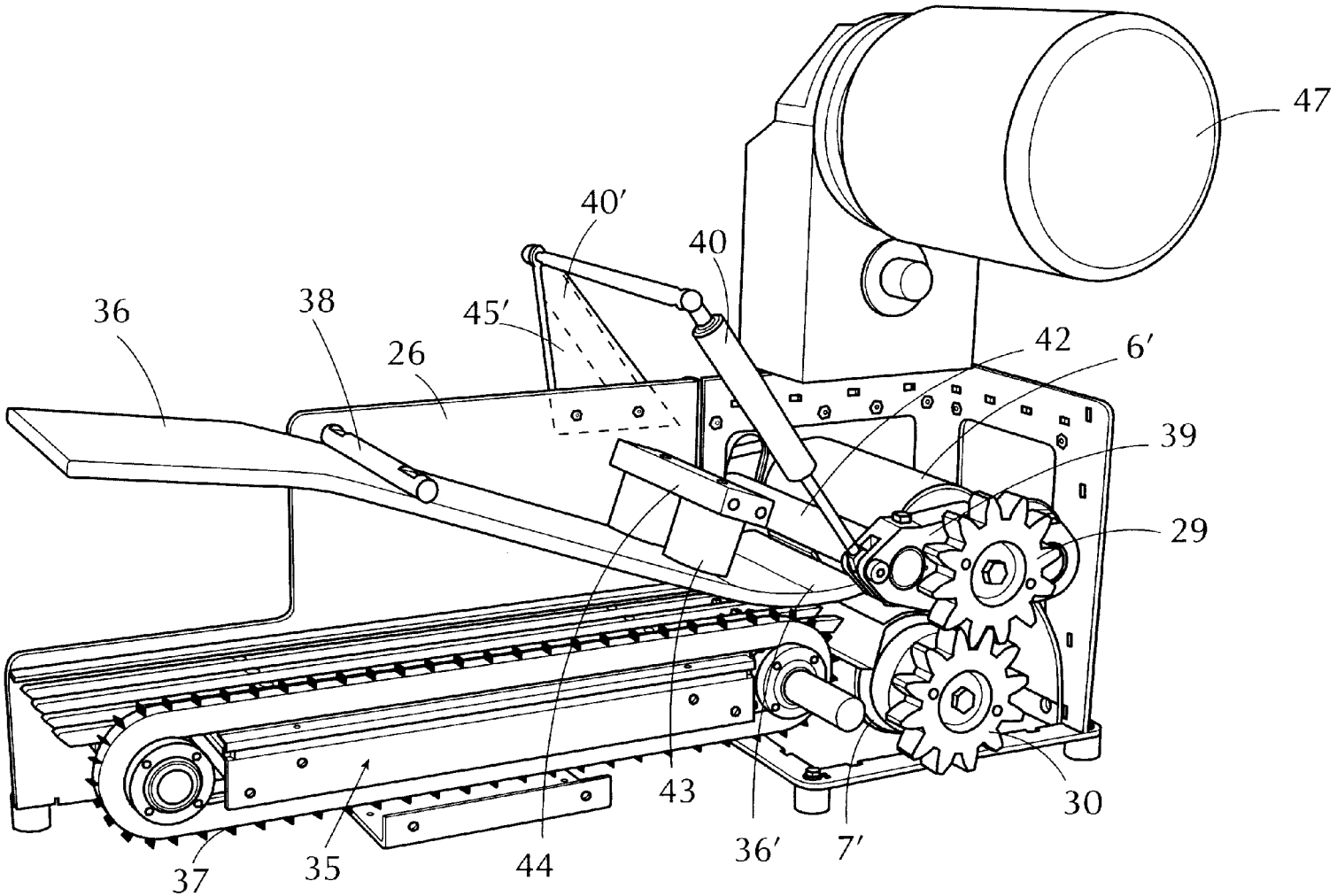
FIG. 6 is a perspective view of the compactor apparatus used with the assembly shown in FIG. 4, and having a side plate removed for clarity.
Figure 7:
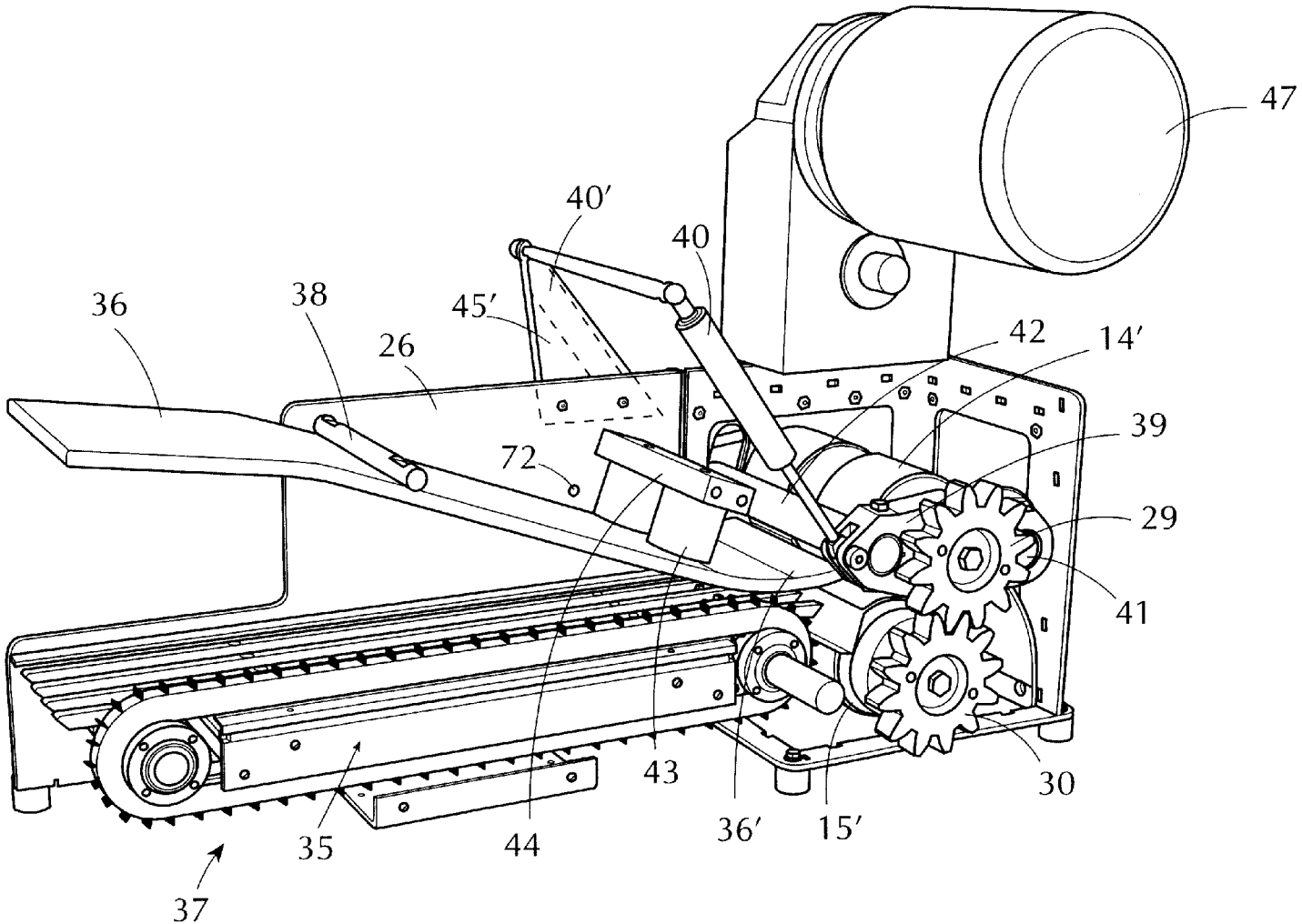
FIG. 7 is a perspective view of the compactor apparatus used with the assembly shown in FIG. 5, and having a side plate removed for clarity.

As indicated in FIG. 1 for the conveyor 1', this may be provided with gripping means 1"", e.g., spikes, barbs or a friction facing which ensures good engagement with the article that is to be fed forcibly towards the squeeze rollers, whilst the article is precompacted. In FIGS. 6 and 7 the gripping means are indicated by means of the reference numeral 37 (denoted by reference number 1"" in FIG. 1).

As was the case with the previous embodiment of the compactor apparatus according to the invention, in this embodiment for processing plastic bottles there is also a need for mechanisms which ensure that both the precompactor and the final compactor release at a given load caused by articles which are not compactable, so that such articles either pass through the compactor apparatus more or less uncompacted or are retrieved by reversing the drive mechanism of the compactor apparatus. If the articles that are inserted are not compactable, the compactor apparatus must of course be capable of handling such articles without the apparatus sustaining any damage in doing so.

By avoiding flattening bottle mouths and bottom nipples, the power requirement is considerably reduced, and this leads to a substantial reduction in the need for mechanical strength in the apparatus and thus also in the costs of the apparatus.

Under normal conditions, the precompactor 1 is to effect the forcible feeding and compraction of metal cans or plastic bottles, such as PET bottles, into the squeeze rollers 6', 7'; 14', 15' in such a way that the squeeze rollers are easily able to grip the precompacted bottle. The precompactor, with its two parts 35 and 36, will thus have to carry out an effective compaction in order to ensure that the compaction rollers have sufficient grip on such precompacted article.

The squeeze device 36 in the form of a press plate which forms the angle $\alpha$ with the conveyor 35 is rotatably supported at its upstream end in a pivot 38. The lower roller 7'; 15' is normally fixedly supported, whilst the upper roller 6';14' is supported in an arm-spring assembly consisting of arms 39, 39' and springs 40, 40', e.g., gas springs. The arms 39, 39' are rotatably mounted about a fixed shaft 41. A cross member 42 extends between the arms 39, 39'. At the downstream end of the precompactor, its inside diameter will preferably correspond to the accessible inside diameter between the squeeze rollers. The press plate 36 may, in the case of the embodiment in FIG. 7, have a recess or cut-out (not shown) at the bottom and on the underside, so that the central part of the downstream end of the precompactor has an inside diameter corresponding to the passageway 20 between the rollers 14', 15', whereby the mouth and bottom nipple of a bottle can more easily pass unobstructed from the precompactor towards the squeeze rollers.

The spring mounting or suspension of the press plate 36 may, e.g., may be made using a spring device 43, e.g., rubber blocks which are fastened in a bracket 44, thereby rendering the function of the precompactor independent of the springs 40, 40'. However, it is conceivable in individual cases that the lower end 36' of the press plate 36 is pressed so far upwards by an article that it will bear against the cross member 42 and thus press the free ends of the arms 39, 39' upwards. The springs 40, 40' at their respective upper part are in engagement with a respective mounting bracket 45, 45'which is fastened to the side walls 25, 26 of the precompactor. A cross member 46 mayo optionally be placed between the upper end of the springs to provide cross stiffening.

Figure 8:
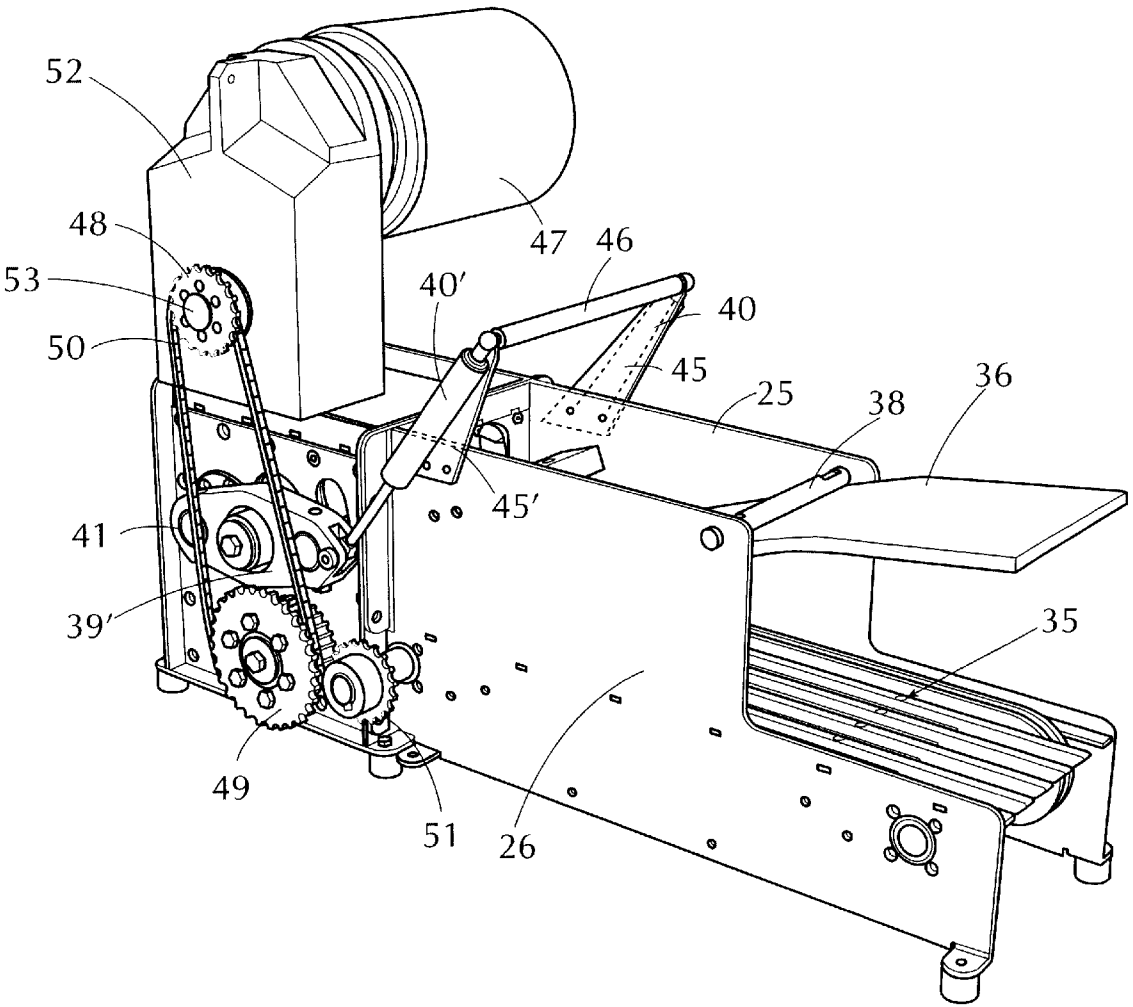
FIG. 8 shows in perspective the compactor apparatus seen from the opposite side.

A motor 47 will via gearwheels 48, 49 and a toothed belt or chain 50 drive the lower roller 7'; 15' and thus the upper roller 6'; 14' via the gearing 29, 30. Furthermore, the gearwheel 49 will drive the conveyor gearwheel 51, as indicated in FIG. 8. The motor 47 may optionally have a transmission 52 between its drive shaft and the output shaft 53 which drives the gearwheel 48.

Although the squeeze rollers 6', 7' and 14', 15' in FIGS. 6 and 7 respectively, and in more detail in FIGS. 4 and 5, primarily are suitable for compacting metal cans and plastic bottles respectively, it will be appreciated that the illustrated embodiments are not limited to handle only this form of disposable packaging, but that, e.g., boxes, cartons having a screw cap or the like also may be compressed using such apparatus.

Under normal operational conditions, the compression forces will be considerably higher in connection with the final compaction than those in effect in the precompactor. A force ratio of 10:1 might be realistic, although of course this should not be understood as defining the limits of the invention.

By studying FIGS. 6–8, it will be understood that the spring forces from the springs 40, 40' will diminish the more the free ends of the arms 39, 39' move upwards, inasmuch as the springs 40, 40' are inclined.

If the end 36' of the press plate 36 had been mechanically connected to the arms 39, 39', the compaction forces in the precompactor and the final compactor, i.e., with the squeeze rollers, would be greatest when the space between the precompactor parts 35, 36 is smallest and similarly when the space between the rollers 6', 7'; 14', 15', is smallest and the forces would decrease with the widening of these spaces. When the arms 39, 39' turn relative to the shaft 41, the torque for the closing force (the springs 40, 40') will be reduced at the same time as the torque for the opening force (caused by the article) increases. For instance, a high compaction force in connection with the rollers 14', 15' during normal operation, i.e., a small space between the rollers, is necessary to provide a permanent deformation of the lateral edges of the bottles.

The embodiment in FIGS. 9 and 10 will now be described in more detail. In both embodiments a common spring mounting is proposed for the precompactor and the compactor using inclined springs 53 fastened in the side wall of the precompactor by means of a fixing bracket 54. Operation of the apparatus can be effected by a rotary motor, indicated schematically by reference numeral 55, which preferably drives the lower roller 56. The conveyor 58 is driven via a chain or belt connection 57, the conveyor 58 belt or chain being moved over respective rotating end rollers 59, 60. The rotation of the lower roller also causes operation of the upper roller 63 via a gear transmission 61, 62.

The compaction plate in FIGS. 9 and 10 is indicated by reference numeral 64 and at its upstream end is rotatably mounted in a journal 65. If non-compressible articles are inserted, the precompactor plate 64 will be lifted at its downstream edge 64' and thus also lift the front edge of the arms 66 about the shaft 67, so that an article of this kind passes unobstructed through the final compactor. In order to provide a necessary spring loading on the arms 66, gas springs 53 may advantageously be used as springs. Other types of counter-force devices are also conceivable. The compaction forces which are caused by the precompactor and by the rollers 1, 2 will thus be limited by the forces exerted by the springs 53, and under normal conditions could be, e.g., ten times greater for the compression rollers 1, 2 than for the precompactor 17.

In FIG. 10 the motor 55 will drive the lower roller 56 and via chain 57 drive the precompactor conveyor 58. The lower roller also drives the upper roller via a drive chain 68 and gearwheels 69, 70 and 71.

In a compactor apparatus of this kind, there will also be a need for technical solutions which ensure that both the precompactor and the rollers are released by a given load caused by articles which are not compactible, and that these can pass through the compactor apparatus more or less uncompressed.

From the system for power transmission between the upper roller 6'; 14' and the lower roller 7'; 15' via gearing 29, 30 it will be understood that the rollers can be moved slightly apart without the gear engagement ceasing. However, if the article that is to pass through the compactor apparatus is too large or of a non-compressible type, the gearwheel engagement will be released, whereby the upper roller 8 will no longer rotate by force via the gearwheels 29, 30. It will normally be desirable to allow the movement of the arms 39, 39' to be limited so that the gripping function of the rollers is maintained, at the same time as the gearwheel engagement is kept up. This means that the gearwheels 29, 30 should have large (long) teeth, so that the engagement is maintained even if the gearwheels travel some distance apart.

However, if the apparatus is so adapted that the gearwheels disengage from each other the gearwheel engagement will function again as soon as an excessively large article of this kind has passed out of the compactor apparatus.

If an article enters the precompactor and is of such a type that it cannot possibly pass between the rollers 8, 9, a detector 72 can be positioned so that it stops the apparatus drive motor 47; 55 if the press plate passes the detector. Thus, an alarm can be given to indicate that the manual removal of such an article is required. Alternatively, the motor can be made to turn in the opposite direction on such detection so that the article is fed back to the point of insertion. As an alternative to the use of the motion detector 72, a speed monitor (not illustrated), of a type that is known per se, may be used which monitors the drive speed of the motor and causes the motor to stop or rotate in the opposite direction if the drive speed falls below a determined threshold. As yet another alternative (not illustrated), the power consumption of the motor can be monitored and the motor made to stop or reverse if the power rises above a certain threshold or the power increase per time unit passes a threshold.

What is claimed is:

1. An apparatus for compacting disposable plastic bottles, comprising a pair of mutually counter-rotatable, interacting squeeze rollers, a precompactor including a conveyor and an elongated squeeze device inclined relative to the conveyor so that the article is gradually flattened upstream of the pair of mutually counter rotatable interacting squeeze rollers and wherein a first said squeeze roller has a fixed support and wherein a second said squeeze roller is supported in an arm-spring assembly, thereby enabling a space between the first and second squeeze rollers to be varied according to the size and compactability of the bottle and wherein the first and second squeeze rollers each have an incurvate portion for providing a virtually free passageway for a mouth and a bottom nipple of the bottle.

2. An apparatus as disclosed in claim 1, characterized in that the squeeze roller arm spring assembly is adapted to move independent of a downstream portion of the squeeze device.

3. An apparatus as disclosed in claim 1, wherein a spring mounting in the spring roller arm spring assembly is mechanically separate and independent of a spring mounting in the squeeze roller device.

4. An apparatus for compacting disposable plastic bottles, comprising a pair of mutually counter-rotatable, interacting squeeze rollers, wherein a first said squeeze roller has a fixed support and wherein a second said squeeze roller is supported in an arm-spring assembly, thereby enabling a space between the first and second squeeze rollers to be varied according to the size and compactability of the bottle, and wherein the first and second squeeze rollers each have an incurvate portion for providing a virtually free passageway for a mouth and a bottom nipple of the bottle.

5. An apparatus as disclosed in claim 4, wherein the incurvate portion is located midway between the roller ends.

6. An apparatus as disclosed in claim 1, wherein a gear drive of the second roller is disengaged when said space exceeds a limit caused by a too large or non-compressible bottle entering said space.

7. An apparatus as disclosed in claim 4, wherein a gear drive of the second roller is disengaged when said space exceeds a limit caused by a too large or non-compressible bottle entering said space.

8. An apparatus for compacting disposable plastic bottles, comprising a pair of mutually counter-rotatable, interacting squeeze rollers, each said squeeze roller having an axis of rotation, wherein a first said squeeze roller has a fixed support and wherein a second said squeeze roller is supported in an arm-spring assembly, thereby enabling a space between the first and second squeeze rollers to be varied according to the size and compactability of the bottle, and wherein the first and second squeeze rollers each have an incurvate portion, each said incurvate portion extending along a circular path around the axis of rotation of each said squeeze roller, said incurvate portions being proximately tangent to define a virtually free passageway for a mouth and a bottom nipple of the bottle at the area of proximate tangency.

* * * * *